United States Patent [19]

Kennedy

[11] Patent Number: 4,667,593

[45] Date of Patent: May 26, 1987

[54] CAN CRUSHING MACHINE

[76] Inventor: Fred R. Kennedy, Box 299, R.R. 1, Indianola, Nebr. 69034

[21] Appl. No.: 904,605

[22] Filed: Sep. 8, 1986

[51] Int. Cl.[4] ..... B30B 9/32

[52] U.S. Cl. ..... 100/215; 100/256; 100/269 R; 100/902

[58] Field of Search ..... 100/902, 215, 256, 269 R; 241/99

[56] References Cited

U.S. PATENT DOCUMENTS 2,619,150 11/1952 Smith .
3,010,665 11/1961 Smith .
3,062,130 11/1962 Huber et al. .
3,659,520 5/1972 Gerrett et al. .
3,916,780 11/1975 Heiser .
4,240,341 12/1980 Whipple et al. .
4,261,259 4/1981 Beardslee .
4,474,108 10/1984 Lonze ..... 100/215 X
4,483,248 11/1984 Ostreng .
4,489,649 12/1984 Daugherty ..... 100/256 X
4,561,350 12/1985 Snoe et al. .
4,570,536 2/1986 Dodd .

*Primary Examiner*—Billy J. Wilhite
*Attorney, Agent, or Firm*—Zarley, McKee, Thomte, Voorhees & Sease

[57] ABSTRACT

A reciprocating ram crushes cans along their longitudinal axis. First and second cams move with the ram and operate first and second holding members which feed the cans one by one into a ram passageway for crushing. A valve actuator is movable with the ram for alternately operating a switching valve for directing hydraulic fluid alternately to opposite ends of the ram to operate it in opposite directions during its cycle of operation.

10 Claims, 6 Drawing Figures

CAN CRUSHING MACHINE

BACKGROUND OF THE INVENTION

Food and beverage businesses commonly sell drinks in cans which can accummulate in large numbers and will occupy a considerable amount of space. The cans have salvage value and can be recycled thereby reducing the overall cost of doing business. An inexpensive, simple to operate machine is needed to crush cans such that they may be efficiently and economically recycled.

SUMMARY OF THE INVENTION

The can crusher of this invention is simple in design, inexpensive to manufacture and foolproof in operation. It will accommodate as many as a thousand cans an hour. The crushing occurs through operation of a hydraulically operated ram which in turn carries with it during operation first and second cams which operate first and second cam-holding members which control the flow of cans from a feed passageway into the ram passageway for crushing. An actuator is also carried on the ram and operates a switching valve to alternately direct fluid to opposite ends of the ram for operating it in opposite directions.

DESCRIPTION OF THE PREFERRED EMBODIMENT

Figure 1:
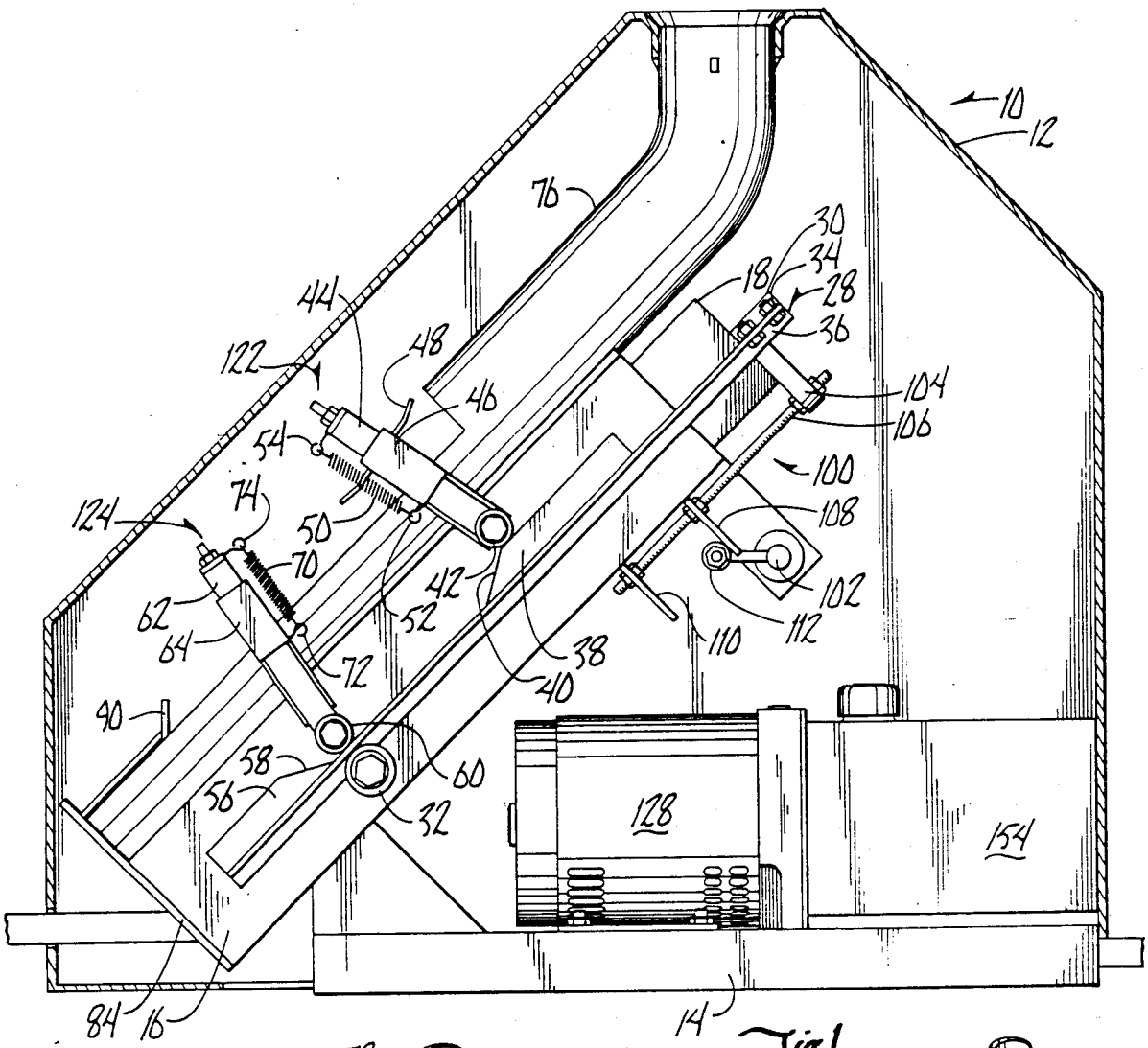
FIG. 1 is a cross-sectional side elevational view of the can-crushing machine.

The can crusher of this invention is referred to generally in FIG. 1 by the reference numeral 10 and includes a housing 12. A base frame 14 supports at an angle a ram cylinder 16 having a ram passageway 17 in which a ram 18 reciprocates.

A double acting hydraulic cylinder 20 is connected at one end by an ear 22 to the side of the cylinder 16 and through an ear 24 the cylinder rod 26 is connected to the upper end of the ram 18. On the opposite side of the ram cylinder 16 is a movable rail 28 connected to the upper end of the ram 18 by a transversely extending member 30. The rail is supported at its lower end by a roller 32 which engages the bottom surface 34 of the horizontal leg of the rail which is L-shaped. A downwardly extending leg 36 of the rail engages the inside surface of the roller 32 and limits lateral movement of the rail. A first cam surface 38 having a downwardly sloping cam surface 40 on its lower end engages a roller 42 on the lower end of a first stop member 44 movable in a sleeve 46. A can-engaging element 48 is carried on the member 44 and is downwardly spring biased by a spring 50 connected at its lower end 52 to the sleeve 46 and at its upper end 54 to the upper end of the member 44.

Figure 2:
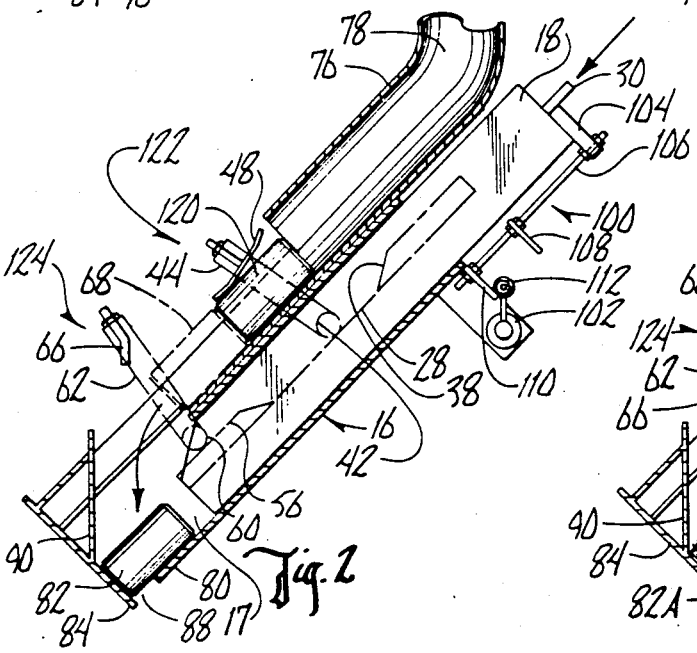
FIG. 2 is a reduced in scale side elevational view showing the ram in its retracted position and the first cam-holding member holding cans from moving into the ram passageway.
Figure 3:
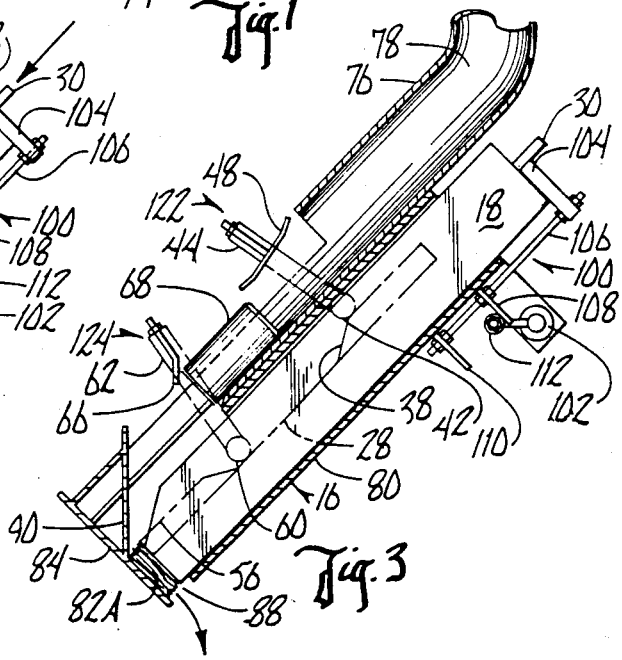
FIG. 3 is a view similar to FIG. 2 but showing the ram in its crushing position and the second holding member holding the cans in the feed passageway.
Figure 4:
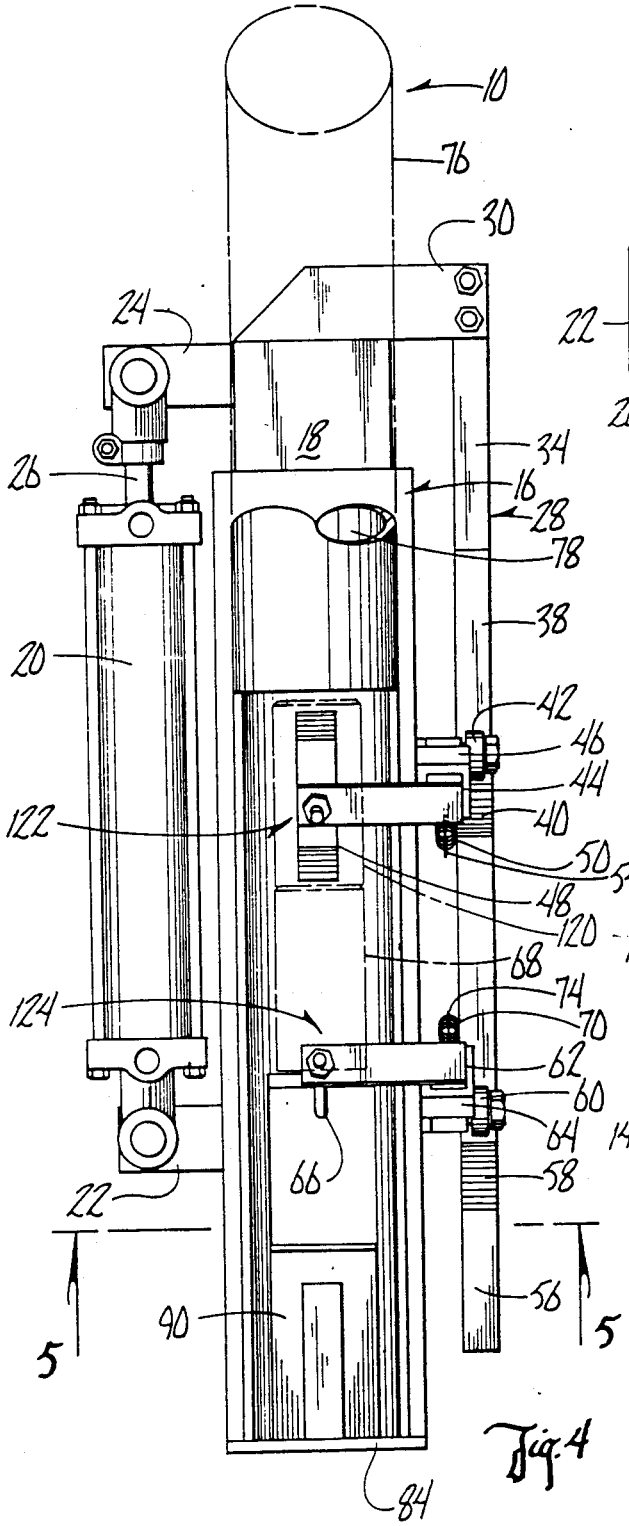
FIG. 4 is a top plan view thereof.
Figure 5:
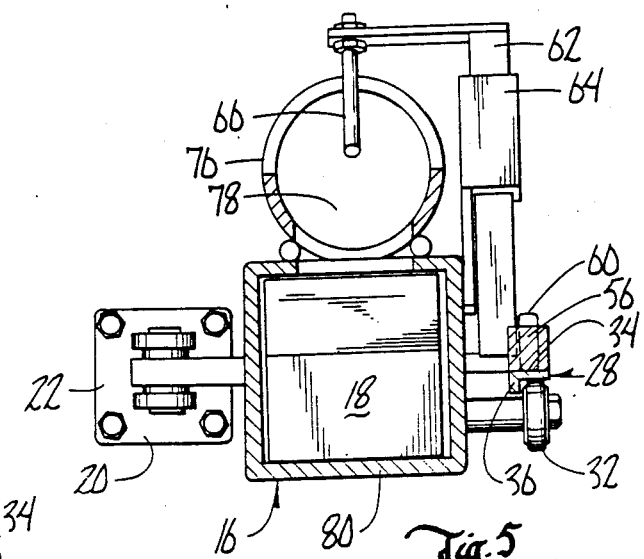
FIG. 5 is a cross-sectional view taken along line 5—5 of FIG. 4.

A second cam member 56 is mounted on the top of the rail 28 and has a cam surface 58 facing upwardly along the rail but extending downwardly towards the rail for engagement with roller 60 on the lower end of member 62 movable in sleeve 64. The member 62 carries a J-shaped stop member 66, as seen in FIG. 2, for engaging cans 68, as seen in FIG. 3. A spring 70 is connected at its lower end 72 to the sleeve 64 and at its upper end 74 to the upper end of the member 62.

A can feeder tube 76 is provided on top of the ram cylinder 16 and includes a feeder passageway 78.

A bottom wall 80 of the ram cylinder 16 supports can 82 when in a position to be crushed, as seen in FIG. 2. The terminal end 84 is spaced from a stop plate 86 defining an outlet opening 88 for the crushed can 82A to fall through after being crushed, as seen in FIG. 3.

A guide plate 90 extends downwardly towards the ram passageway 17 from the feed passageway 78 to deflect cans downwardly into the ram passageway 17, as seen in FIGS. 2 and 3.

Figure 6:
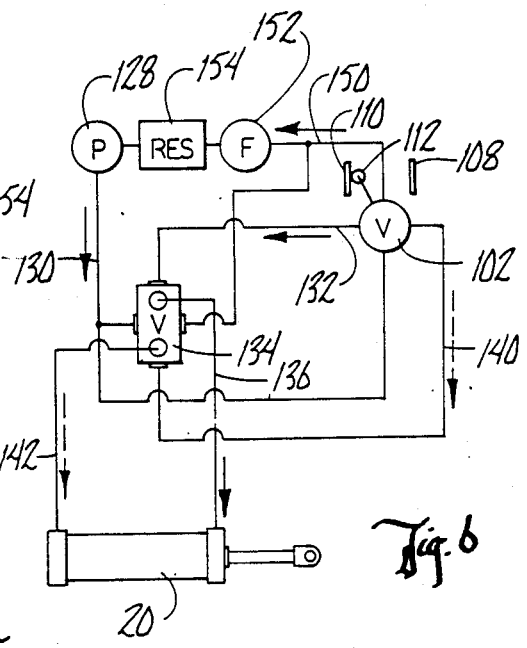
FIG. 6 is a hydraulic schematic.

The ram 18 also carries a valve actuator 100 for actuating valve 102. A member 104 extends from the upper end of the ram 18 downwardly below the rail 28 and a threaded rod 106 extends downwardly along the rail and the ram cylinder 16 and includes downwardly extending actuator elements 108 and 110 between which an arm 112 on the valve 102 is positioned. The elements 108 and 110 may be selectively positioned along the length of the threaded rod 100 to appropriately engage the arm 112 at the right time to cause a reversal of the direction of travel of the ram, as seen in the hydraulic schematic in FIG. 6.

Thus in operation it is seen that the feed tube 76 may hold a supply of cans in an end-to-end relationship. Cans can be fed in at the upper end of the tube or supplied from a remote source such as in a restaurant or bar feeding cans to the machine in the basement (not shown). When a can 82 is in position to be crushed, as seen in FIG. 2, in the ram passageway 17, the next can 120 is being held by the member 48 of the first holder 122. The second holder 124 is inoperative at this moment. The member 44 of the first holder is in its down position held by the spring 50 while the member 62 of the second holder 124 is in its up position due to engagement of the roller 60 on the cam surface 58 thereby allowing can 82 to move into the ram passageway 17 to be crushed by the ram 18. When the ram moves to its down position, as seen in FIG. 3, the holder 122 is rendered inoperative by the roller 42 engaging the cam surface 40 and raising the member 44 to its up position, as seen in FIG. 3, thereby allowing a can 68 to move by it and be stopped by the element 66 on the second holder 124 which is now in its down position as it has moved out of engagement with its cam surface 58.

The pump 128 may be turned on by a manual switch (not shown) or by a microswitch operated by a can moving down the feed tube 76 (not shown). When the pump 128 is operating oil is directed through line 130 to the switching valve 102 and in one position oil will flow through line 132 to one end of valve 134 thence into line 136 to the forward end of the hydraulic cylinder 20 to move the rod 26 to its retracted position and the ram 18 to its down crushing position of FIG. 3. When the actuator plate 108 in FIG. 3 engages the arm 112 it moves the valve to its second position thereby directing fluid now through the line 140 to the lower end of the valve 134 thence out through the line 142 to the opposite end of the cylinder for extending the cylinder rod 26 and moving the ram 18 to its up position, as seen in FIG. 2, thereby allowing a can 82 to drop into the ram passageway 17. The upward travel continues until actuator element 110 engages the valve arm 112 and moves it to the position shown in FIG. 3, again reversing the hydraulic fluid flow through the valve 102, then the cycle is repeated. Oil returning from the cylinder passes through the valve 134 and the valve 102 in a reversed direction and returns through a line 150 to a filter 152 to a reservoir 154 where it then returns to the pump 128.

Having thus described the invention by way of a specific example thereof, what is claimed as novel is defined as follows:

1. A can-crushing machine comprising, a reciprocating ram movable in a ram passageway to crush a can against a stop, power means for operating said ram, an outlet opening in communication with said ram passageway for discharge of a can after it is crushed, a can-feed passageway having an outlet opening in communication with said ram passageway, first and second releaseable can-holding means in said can-feed passageway movable between holding and open positions to control the movement of cans into said ram passageway, sycronizing means for coordinating the operation of said first and second can-holding means with the movement of said ram, said first holding means being in a holding position when said second holding means is in an open position and said ram is moving towards said stop to crush a can having moved past said second holding means into said ram passageway, and said second holding means is in a holding position when said first holding means is in an open position and said ram is moving away from said stop in preparation for another can moving into said ram passageway between said ram and said stop.

2. The structure of claim 1 wherein said feed passageway is located above said ram passageway and is angled downwardly to provide a gravity feed into said ram passageway.

3. The structure of claim 1 wherein said first and second holding means and said sycronizing means are further defined as including cooperating cam and roller means.

4. The structure of claim 3 wherein said cam means is movable by said ram and said roller means is carried by said first and second holding means, and said roller means are positioned in the line of travel of said cam means.

5. The structure of claim 4 wherein said cam means reciprocates along a line parallel to said ram line of travel and said first and second holding means move along lines extending transversely of said parallel lines.

6. The structure of claim 5 wherein said cam means includes first and second cam surfaces, said first surface adapted to engage said first holding means roller and raise said holding means to said open position while said second cam surface is inoperative and said second holding means is in said holding position, and said second cam surface is adapted to engage said second holding means roller and raise second said holding means to said open position while said first cam surface is inoperative and said first holding means is in said holding position.

7. The structure of claim 6 wherein said holding means are normally spring biased to said holding position and are moved to said open positions by said cam surfaces against the action of spring means.

8. The structure of claim 1 wherein said power means includes a double acting power cylinder connected to said ram, and a switching means is provided for alternately directing fluid to opposite ends of said power cylinder.

9. The structure of claim 8 wherein an actuating means is operatively carried on said ram positioned to engage said switching means for moving it alternately between first and second positions for alternately directing fluid to opposite ends of said power cylinder.

10. The structure of claim 1 wherein said cans are held in said feed passageway and are fed into ram passageway in end-to-end relationship and crushing of said cans is along their longitudinal axis.

* * * * *